US005339644A

United States Patent [19]

Singh

[11] Patent Number: 5,339,644

[45] Date of Patent: Aug. 23, 1994

[54] DEFROST SYSTEM FOR REFRIGERATION APPARATUS

[76] Inventor: Kanwal N. Singh, 2701 Indianola Ave., Columbus, Ohio 43202

[21] Appl. No.: 55,136

[22] Filed: Apr. 29, 1993

[51] Int. Cl.[5] ..... F25D 21/08

[52] U.S. Cl. ..... 62/234; 62/275

[58] Field of Search ..... 62/277, 275, 282, 278, 62/155, 234, 81, 82

[56] References Cited

U.S. PATENT DOCUMENTS

| | | | |
|---|---|---|---|
| 2,130,036 | 9/1938 | Shrader | 62/282 X |
| 2,616,272 | 11/1952 | McCloy | 62/275 |
| 2,661,602 | 12/1953 | Lanker | 62/275 X |
| 2,709,345 | 5/1955 | Ramsey | 62/275 |
| 2,781,641 | 2/1957 | Foley | 62/275 X |
| 4,027,497 | 6/1977 | Thurman | 62/275 X |

*Primary Examiner*—Harry B. Tanner
*Attorney, Agent, or Firm*—Robert E. Stebens

[57] ABSTRACT

A refrigeration apparatus is provided having a refrigeration system including means to enable automatic defrosting of the evaporator that is located in the compartment where food products are maintained at a temperature that is below the freezing point of water. The system includes a defrosting evaporator located exteriorly of the freezer compartment and connected in series flow relationship with the freezer evaporator whereby refrigerant first flows through the defrost evaporator and then through the freezer evaporator. The system includes means for applying heat to the defrost evaporator at periodic intervals of time to elevate the temperature of the refrigerant flowing through the freezer evaporator to a level above the freezing point of water. In one embodiment, this heat is obtained from an electrical resistance heating element disposed in heat-transferring relationship to the defrost evaporator. In other embodiments, the heat is extracted from air that is at a temperature which is above the freezing point of water by causing circulation of that air into heat-transferring relationship with the defrost evaporator.

13 Claims, 4 Drawing Sheets

DEFROST SYSTEM FOR REFRIGERATION APPARATUS

FIELD OF THE INVENTION

This invention relates in general to refrigeration apparatus that is designed for maintaining of foods edible for human consumption at a temperature which in, at least one of the compartments, would be below the normal freezing point of water. This invention relates more particularly to a defrosting system adapted to be incorporated into a conventional refrigeration system and operable to effect removal of frost and ice that may form and accumulate on the evaporator located in the freezer compartment.

BACKGROUND OF THE INVENTION

Refrigerators designed for use in personal residences are of two basic types. One type does not provide any means whatsoever for effecting defrosting of the evaporator that is placed in a compartment for effecting freezing of foods. It is thus necessary at periodic time intervals to perform manual operations to effect removal of frost and ice that accumulate over a period of time on the evaporator surfaces. Refrigeration apparatus of this type frequently utilizes an evaporator embodying a construction that is designated as a plate-form construction that is utilized in substantial part because of its economy of manufacture. A plate-form evaporator also has a structural advantage in that it can also perform the auxiliary function of supporting the food products.

Defrosting of a refrigerator, specifically the freezer evaporator, is a time-consuming task and generally requires that the refrigerator be placed in an inoperative condition for a period of time. It also frequently requires that the food products be removed from the freezer compartment in order that appropriate measures may be taken to apply the necessary quantity of heat to the evaporator surfaces to effect the defrosting and, in particular, to effect sufficient melting of ice accumulations so that the ice may be removed. Defrosting techniques currently employed often involve the placement of containers of heated water in the freezer compartment and either adjacent to or supported on the evaporator. This technique invariably results in the further complication because melted frost and ice generate water that must somehow be picked up and manually removed. Particles, or chunks of ice, are also invariably produced and they must be removed. Generally, this manual defrosting procedure creates a significant cleanup problem.

To alleviate this defrosting problem, refrigeration apparatus for domestic use has been designed to incorporate structure and control systems to effect automatic defrosting. Such refrigeration systems with automatic defrosting features usually incorporate an evaporator which is of a construction that is generally designated as a "fin coil". This fin coil is placed in the freezer compartment and is functionally connected with other components of the refrigeration system such as the compressor, a condensor that is mounted exteriorly of the freezer compartment and the necessary control devices such as an expansion valve. Defrosting is effected by application of heat to the fin coil and this is accomplished at periodic intervals normally controlled by electrical circuit timers. While the current technology of automatic defrosting refrigeration systems do accomplish the intended objectives, they are not efficient from a cost standpoint in operation and, furthermore, they require incorporation of components that substantially increase the basic cost of the refrigeration apparatus. Heat for effecting defrosting is normally provided by means of an electric heating element. This heating element must be placed in close proximity to the fin coil evaporator in the freezer compartment and this factor further adds to the increased costs of automatic defrost freezers in that it significantly complicates the design and configuration of the evaporator as well as restricting their physical location in the freezer compartment.

These current technology automatic defrosting systems also are costly to operate. Sufficient heat must be applied to effect melting of the ice and/or the frost that is formed on the fins of the evaporator. To complete defrosting, it is necessary to apply this heat over a fairly prolonged period of time in order to assure that there will be sufficient heat transfer to effect the melting. Ice is an insulator and this further adds to the complications of defrosting as the heat must be applied for a sufficient time to melt the ice until the heat actually reaches the evaporator surfaces. With ice being a thermal insulator, it is also undesirable to permit large accumulations of ice to form on the evaporator as the ice will then also seriously erode the cooling or freezing efficiency of the system. In a defrost mode of operation, the electrical defrost heater must produce heat at a rate which is greater than the cooling capacity of the freezer system and often this heat generation must be at a rate which is three to four times the cooling capacity rate. Further adding to the inefficiency of the automatic defrosting system is the fact that the electric heater necessarily generates space heat that is dissipated into the freezer area. Once the defrosting cycle has been completed, it then becomes necessary for the refrigeration system to then work in the freezing cycle for an extended period of time to effect removal of this added heat. The cost of operating the freezer provided with automatic defrosting is relatively greater than with a freezer that does not have the automatic defrost feature. The comparative relative cost of operation may well be in the order of the automatic defrost system consuming two to three times the energy that is otherwise required by a refrigerator which is not provided with an automatic defrost system.

A further disadvantage of the current technology systems of automatic defrost refrigeration apparatus is that such systems cannot be applied or incorporated with most commonly designed freezers such as those with the plate-type evaporators. These plate-type evaporators are of a design which covers a relatively large physical area, and thus, they are not readily adapted to having means for applying heat to effect defrosting such as is the case with the fin coil type evaporators. In addition to the lower cost refrigerators which are provided with such plate-type evaporators, most common upright or chest-type freezers adapted for utilization in residences are also of the type having such plate-form evaporators. Consequently, these freezers which essentially comprise the types that are found in residences, and many commercial installations, are also not adapted to automatic defrosting and must be defrosted by manual techniques.

SUMMARY OF THE INVENTION

A refrigeration apparatus including defrosting capabilities is provided by this invention for utilization in association with residential household type refrigerators. The refrigeration apparatus of this invention includes a second evaporator which is designated herein as a defrosting evaporator coupled in series relationship with the primary or first evaporator of the refrigeration system that performs the function of providing the cooling such as in the freezing chamber of a refrigerator. This defrost evaporator is positioned exteriorly of the freezer compartment in which the first evaporator is located and functions. Thus, the defrost evaporator is not subject to formation of frost or ice on its exterior heat transfer surfaces to the same extent as is the freezer evaporator. Provided in association with the defrost evaporator is mechanism for effecting application of heat to this evaporator at periodic intervals to perform the defrost function. Refrigerant flowing through the conduit interconnecting the several components will thus first flow through the defrost evaporator and then through the evaporator of the refrigeration or freezer compartment. When in a cooling mode, the refrigerant thus will result in cooling of the defrost evaporator as well as providing cooling through the primary or first evaporator. The effect of cooling the defrost evaporator is minimized in the basic system of this invention as it is located in a closed chamber forming a dead air space from which ambient air is essentially excluded, resulting in minimal formation of frost or ice on the defrost evaporator. At periodic intervals when the system is operating in a cooling mode with refrigerant flowing through the interconnecting conduits, sufficient heat is applied to the defrost evaporator to elevate the temperature of the refrigerant to a level which is above the freezing point of water. This refrigerant, when thus elevated in temperature and then subsequently flowing through the first evaporator, will result in transmission of heat to the heat transfer surfaces of that first evaporator. The effect of this heat produced by the refrigerant is to melt frost or ice that has accumulated on the surfaces of the first evaporator. This has an advantageous result in that the heat is directly applied to the surface of the evaporator, and to the frost or ice adhering to those surfaces, and can thereby more rapidly effect melting of the frost and ice. As a consequence, the frost and ice is very quickly loosened or removed from the surfaces of the evaporator without first having to effect a total thawing or melting of the ice as is the case with the automatic defrost systems heretofore employed in refrigeration apparatus of this type. The amount of heat that is required and the time for effecting melting of the frost and ice, or loosening for removal, is also markedly reduced with the defrost system of this invention as compared to the prior art defrost systems where the heat is applied first to the exterior surfaces of the frost and ice.

In the basic embodiment of this invention, the defrost evaporator may be exteriorly located to the refrigeration unit or housing, and thus, it is exposed to ambient air. Heat is applied to the defrost evaporator by energization of an electrically powered heating element which has its operative portion supported in close proximate relationship to the defrost evaporator. That defrost evaporator may be of the plate-type or it may be of the fin coil type which may proportionally have a greater heat transfer surface. A timing mechanism is advantageously incorporated in the control circuitry for the heating element and is operative to energize the heating element at periodic intervals for predetermined time periods that are sufficient to effect the defrost function.

A second embodiment of the invention includes the evaporators in the respective compartments of a household refrigerator and the defrost evaporator is, in effect, formed by the evaporator located in the refrigeration or cooling section which is not operative to lower the temperature to the freezing point of water. Heating is obtained by providing of an air-circulating fan located in operative relationship to the defrost evaporator, or the cooling evaporator, and, since the air in that section of the refrigerator is above freezing, it results in the transfer of heat to elevate the temperature of the refrigerant flowing through the system. The result is that the refrigerant then flowing for a period of time through the evaporator of the freezer compartment will be above freezing and thereby effect melting of the frost and ice that may be formed on the evaporator in the freezer compartment, and thus, effect the defrost function. The advantage of this second embodiment is that it is also less costly to manufacture and, furthermore, it is less expensive to operate in performing of the defrost function. Operating expense is significantly reduced since it is not necessary to generate heat for elevating the temperature of the refrigerant and the only cost is that of the electricity necessary to operate the air-circulating fan that creates a flow of the ambient air in the refrigeration compartment across this second evaporator.

These and other objects and advantages of this invention will be readily apparent from the following detailed description of three embodiments of the invention and the accompanying drawings illustrating the components of the system and their interconnection.

DESCRIPTION OF THE DRAWING FIGURES

DETAILED DESCRIPTION OF THE ILLUSTRATIVE EMBODIMENTS OF THE INVENTION

Figure 1:
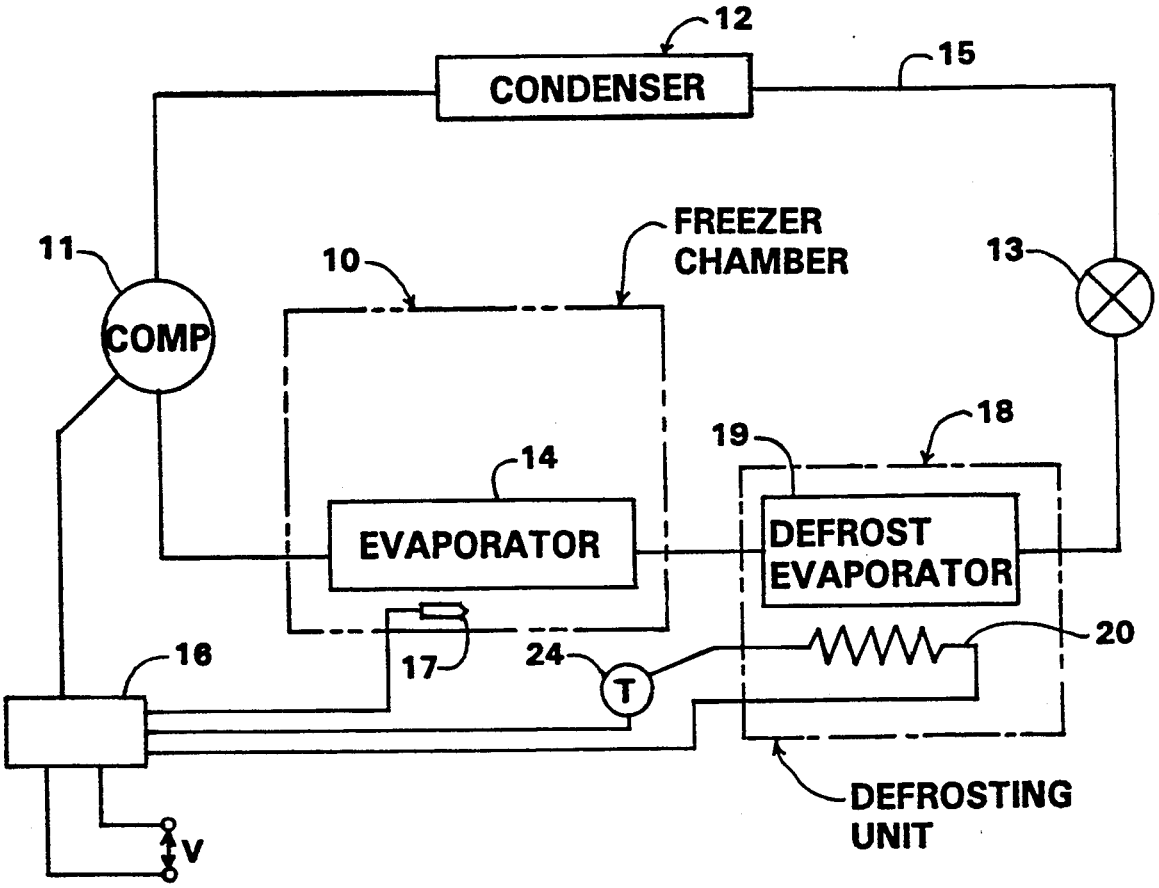
FIG. 1 is a schematic block diagram of a refrigeration apparatus embodying this invention having a defrost evaporator which is located exteriorly of the freezer compartment.

A basic embodiment of the invention is shown in the block-type schematic diagram of FIG. 1. Specifics of the mechanical structure are not illustrated as such components are well-known to those familiar with the refrigeration art. In particular, the diagrams do not illustrate the physical structure of standard components such as refrigerators or refrigeration housings as the mechanical details of the physical structures do not form a part of this invention. In FIG. 1, a refrigeration chamber 10 is shown by broken line without further illustration or description of the physical structure. As is well-known, a refrigeration chamber basically comprises a housing formed with thermally insulated walls and provided with an opening or door for access and thereby enables placement or removal of food articles into or from the interior of the chamber. Provided in association with the refrigeration chamber is a refrigeration system which, as is customary, will have the several components thereof either mounted on or in the housing containing the refrigeration chamber and intercoupled therewith to perform the function of cooling the interior of the refrigeration chamber.

A typical refrigeration system includes a compressor 11, a condensor 12, an expansion valve device 13 and an evaporator 14. These basic components forming the refrigeration system are operatively interconnected in series relationship by a refrigerant conduit 15. The evaporator 14 is the component that provides the cooling in the refrigeration chamber and is thus located within the interior of that compartment. Depending upon the specifics of a particular apparatus, the refrigeration chamber may be provided with air-circulating means such as electrical powered fans that direct and circulate the air over and around the evaporator to more efficiently effect heat transfer and uniformity in the cooling of the interior of the compartment along with its contents. Appropriate control devices of a customary nature are provided to effect operation of the compressor as well as any other components that may perform either sensing or control functions. In FIG. 1, a control mechanism designated generally by the numeral 16 is shown as being electrically coupled with a suitable electrical power source to the compressor 11. This mechanism is shown as being provided with a temperature sensing probe or element 17 that is located within the refrigeration chamber. This probe 17 senses the temperature within that chamber and is operative to effect actuation of the control mechanism 16 for either energizing or de-energizing the compressor 11. Its function is to cause the compressor to operate and effect a flow of refrigerant through the conduit 15 and the interconnected components when the temperature within the chamber exceeds a predetermined magnitude. The control mechanism is normally of a type such that it will maintain the compressor in operation until the temperature within the chamber is reduced to a certain level below the maximum acceptable temperature level.

In accordance with this invention, a defrosting unit 18 is provided in combination with the basic refrigeration system to automatically effect a defrosting function. This defrosting unit 18 is located exteriorly of the refrigeration chamber, but as with the other components of the system, it is advantageously mounted on or in the housing of the refrigeration unit. Included in the defrosting unit 18 is a defrost evaporator 19 and a heating element 20. The defrost evaporator 19 is interconnected in the refrigerant conduit 15 in preceding relationship to the evaporator 14 which, for convenience of identification, is designated as the first evaporator. This defrost evaporator, as is the first evaporator, is connected in downstream relationship to the expansion valve 13 and thus the refrigerant, in its gaseous state as it leaves the expansion valve, is similarly routed through both of the evaporators. In the normal mode of operation, the defrost evaporator is also functioning to effect cooling of the surrounding air, but since it is located exteriorly of the refrigeration chamber and is not exposed to ambient air, it does not form, or at least form to any great extent, frost or ice on the heat exchange surfaces of that evaporator.

Figure 1A:
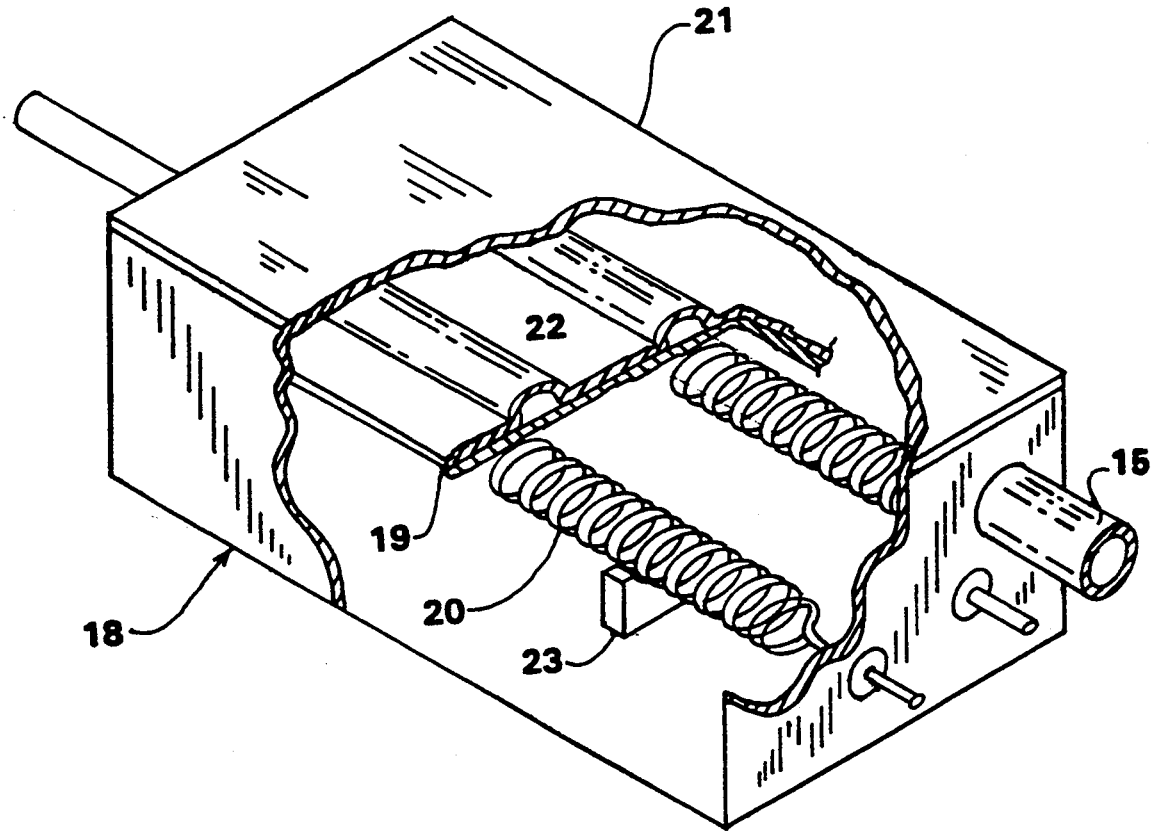
FIG. 1A is a perspective view of a typical defrosting unit for incorporation in the refrigeration apparatus shown in FIG. 1.

The heating element 20 of the defrosting unit is shown in FIG. 1 as being of an electrical type having a resistance-type element that generates heat when an electrical current is passed through that element. The heating element is physically supported in fixed relationship to the defrost evaporator and is disposed in close proximity thereto. It is positioned in a manner so that it will quickly and efficiently transfer heat to the defrost evaporator. In this basic embodiment of the invention, the defrosting unit 18 includes a closed chamber 21 in which the defrost evaporator 19 and heating element are both mounted. An exemplary chamber 21 is shown in FIG. 1A with portions of the chamber's walls being broken away to better illustrate the physical relationship of the components. The defrost evaporator is shown as being of expanded plate-form construction having an integral passage 22 for routing of the refrigerant therethrough, but other evaporator constructions may be utilized. Suitable supports 23 are provided for maintaining the heating element in thermally and electrically insulated relationship to the chamber walls and the evaporator. The physical construction and support of the defrost evaporator and its associated heating element are not otherwise illustrated or described as these are matters of design and engineering choice dictated primarily by the type and relative capacity or sizes of the unit. For the purposes of this description, it will suffice to merely note that the defrost evaporator and its associated heating element, being located in the closed chamber, are maintained in a dead air space that is essentially unaffected by the moisture content of the ambient air surrounding the chamber. Thus, the air in the chamber will have a relatively low moisture content resulting in minimal formation of ice on the defrost evaporator.

Operation of the heating element is coordinated with the functioning of the refrigeration system. Specifically, the defrost evaporator and its heating element are designed to operate in coordinated relationship with the functioning of the first evaporator 14 and the compressor 11. Thus, the heating element 22 has its electrical element interconnected with the control mechanism 16. It will, therefore, be energized whenever the compressor is also energized and operating to induce a flow of refrigerant through the system. Since the defrost evaporator only needs to function for small periods of time, the defrosting unit 18 also includes a timer 24 that is connected in the electrical circuit of the heating element. For a normal size household refrigerator, the defrosting unit constructed in accordance with this invention need operate for only a few minutes at any of the predetermined times that is necessary to function for effecting the defrosting. The time periods of operation are determined in accordance with the capacity of the particular refrigeration apparatus. Accordingly, no specifics as to times or time cycles are described as those would be determined through appropriate engineering design calculations for a specific size and type of refrigeration apparatus.

Figure 2:
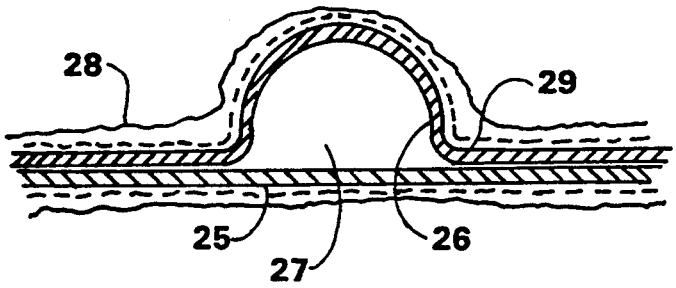
FIG. 2 is a diagrammatic sectional view on an enlarged scale of a plate-type evaporator illustrating the defrosting function of the apparatus of this invention.

The reason why the defrosting system and refrigeration apparatus of this invention operates efficiently and effectively is easily explained by reference to FIG. 2. FIG. 2 is a cross-sectional view through a typical evaporator that is of the plate-form type. This evaporator includes a pair of plates 25 and 26 with one of the plates, 26, being formed with expanded wall sections that define portions of a refrigerant conduit in association with the opposing plate 25. The two plates are secured together by suitable techniques that form fluid-type seals and thus are effective in containing the refrigerant within the conduit space generally designated by the numeral 27. When functioning in a freezing mode, the evaporator, when confined within the refrigeration chamber, causes formation of frost and ice on the exterior surfaces. This frost and ice is shown diagrammatically and in an exaggerated form as a layer of ice 28. In a typical household refrigerator, the refrigerating unit will normally operate and function for time periods of the order of six hours and then the system is designed to effect the automatic defrosting function. Over this period of time, a layer of ice 28 is formed and it adheres to the exterior surfaces of the evaporator. The ice, being a thermal insulator, gradually will diminish the rate of heat transfer as it builds up and it is thus necessary at periodic intervals to remove that layer of ice. With the system of this invention, that is accomplished by the automatic energization of the defrosting unit 20, such as by energization of the electrical heating element 20.

Upon functioning of the defrosting unit 18, such as in accordance with the dictates of the timer 24, heat will be generated by the element 20 and transferred to the defrost evaporator 19 and result in elevating of the temperature of the refrigerant contained within the conduit space 27. The heat that is applied will be sufficient in accordance with the functional operating characteristics of the system to raise the temperature of the refrigerant to a level that is above the freezing point of water. This elevated temperature may be in the range of 5–10 degrees above the freezing point as it is not necessary to raise the temperature of the refrigerant to any substantial extent. With the refrigerant thus at a temperature above the freezing point of water then circulating through the conduit and through the first evaporator 14, it will effect a transfer of heat through the walls of the evaporator. That heat, in turn, will then operate to effect melting of the adjacent layer of ice forming a liquified layer 29 with the heat then subsequently radiating outwardly through the layer of ice to further effect the defrosting function. This heat transfer effect thus demonstrates the reason the defrosting system of this invention is more effective and efficient than with the customary type of automatic defrost apparatus incorporated in conventional types of household refrigerators or other types of refrigeration apparatus. The heat does not need to be transferred through or to act on the entire body or layer of ice. Since the heat transfer is from the evaporator in an outward direction, it, in many cases, depending on the physical orientation of the components, can effect dislodging of the layer of ice and causing it to break up into particles that may fall into suitable receptacles or areas where it may be easily removed. As can be seen in the diagram of FIG. 2, the heat developed by the refrigerant and transferred through the walls of the evaporator is effective in initially causing melting of a layer of the ice immediately adjacent the surfaces of the evaporator. This liquified layer of material is diagrammatically indicated by the numeral 29. If the system is properly designed and operated, only a relatively thin layer of ice is permitted to accumulate and will be easily and quickly removed.

Figure 3:
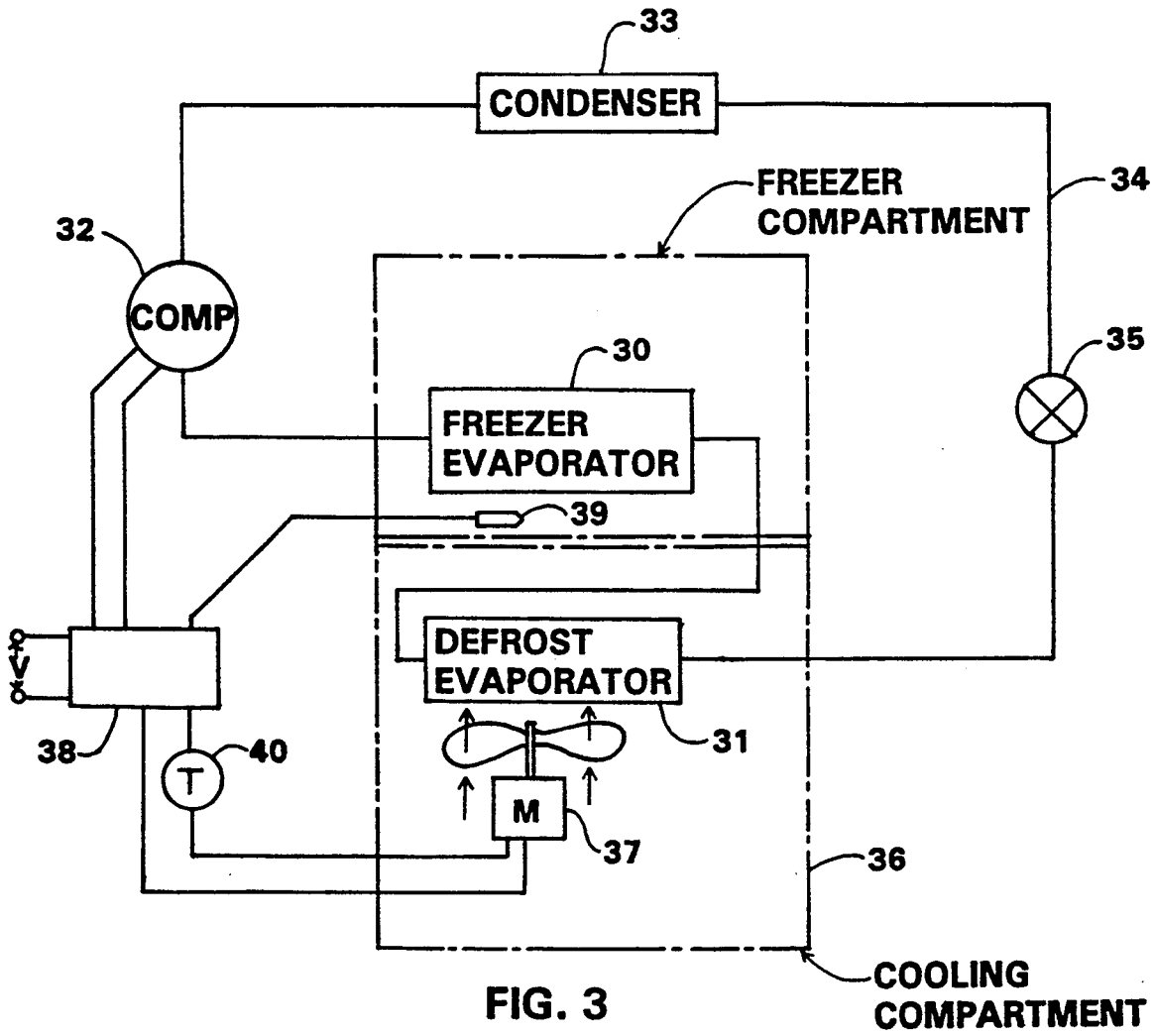
FIG. 3 is a schematic block diagram of a modified refrigeration system for a refrigerator having both a freezer compartment and a cooling compartment with their respective evaporators and the evaporator in the cooling compartment functioning as the defrost evaporator.

A second embodiment of the invention is diagrammatically illustrated in FIG. 3. This embodiment is similar in the basic concept to that illustrated and described with respect to FIG. 1 in that it also includes two evaporators, namely, a freezer compartment evaporator 30 and a second or defrost evaporator 31. This defrost evaporator 31 is located in the cooling section of an ordinary type of household refrigerator. This cooling section is equivalent to the food chilling or cooling section and does not effect freezing of the food. These two evaporators are mounted within the main housing structure of the refrigerator and other components of the refrigeration system are also mounted on or in that housing. These other components also include a compressor 32, condensor 33, refrigerant conduit 34 and expansion valve 35. All of these components, as is conventional, are interconnected in series and as is described with the system of FIG. 1. In this embodiment, the second or defrost evaporator 31 is disposed in the food cooling or chilling compartment of a conventional household refrigerator with that compartment designated as the defrosting unit 36.

The defrosting unit 36 in this embodiment differs from that of FIG. 1 in that it does not include an electrical heating element to effect the periodic elevation of the temperature of the refrigerant flowing through the conduit 34. In this embodiment, the heating effect is obtained by extracting heat from the interior of the cooling compartment by means of an electrically operated, air circulating fan 37 that is disposed and supported in operative relationship to the defrost evaporator 31. This defrost evaporator is located, as previously indicated, in the cooling compartment and has the primary function of effecting transfer of heat from that cooling compartment to the refrigerant to effect the defrosting function. It also functions to provide some cooling effect to the air space and food products that are placed in the cooling compartment. A conventional household refrigerator of the prior art structure does not include, in most cases, an evaporator similar to that which is the defrost evaporator 31, as the cooling effect is normally obtained by circulation of cold air from the freezer compartment. The fan 37 is connected by the appropriate electrical wiring to a control mechanism 38 that functions to control the operation of a compressor 32. This control mechanism also includes a temperature sensing probe 39 having its sensing element located in the freezer compartment. This location of the temperature sensing probe is effective as freezing of the food in that compartment is a primary control function. Whenever the system is operating to effect cooling in that compartment, it will also concurrently cause operation of the freezer evaporator and result in lowering of the temperature in the freezer compartment.

Functioning of the defrost system in the FIG. 3 embodiment is essentially the same as that described in detail with respect to the FIG. 1 embodiment. At periodic times, the system is placed in a defrost mode of operation by energization of the electrical circuit to the fan 37. Operation of the fan circulates the air in the cooling compartment over the defrost evaporator 31. Since the air in the cooling compartment is above the freezing point of water, the refrigerant, as it flows through the defrost evaporator, will have its temperature elevated and effect defrosting of the freezer evaporator 30. An electrical timer 40 incorporated in the circuit of the fan 37 operates to maintain the fan in operation for a period of time to effect defrosting. The advantage of this embodiment over that of FIG. 1 is that it effects even greater efficiency and lower costs of operation in that it does not require generation of heat by an electrical heating element to effect the defrost function as the air in the cooling space and fan 37 form a heat generating means. The heat is simply extracted from the air within the cooling compartment. While this will cause a slight increase in the temperature of the air in that compartment, this will not seriously effect the cooling of the food products. The time of operation of the fan 37 is relatively short, such as in the order of three to five minutes. That length of time is sufficient to elevate the temperature of the refrigerant in the conduit 34 to a level which is above the freezing point of water and because of the efficiency of the heat transfer, as described with respect to FIG. 2, results in completion of the defrost mode of operation in a similarly short period of time.

A third embodiment of the invention is diagrammatically illustrated in personal residences. However, use of this invention is not so limited and can be easily adapted to residential freezers such as those of either the upright or chest-type. Such freezers have not heretofore been provided with defrosting apparatus. Their physical construction and characteristics have not readily lent themselves to use of automatic defrosting mechanisms such as those that have been developed for the typical household refrigerators having freezer and cooling compartments. These household freezers are generally of a capacity that is much larger than that of the freezer compartment of the typical household refrigerator and, consequently, have relatively larger heat transfer surfaces upon which ice forms and is accumulated. Also, these freezers of designs heretofore available generally have evaporators of the plate-type which did not readily adapt to the prior art defrosting mechanisms. The defrosting system of this invention is readily adapted to these freezers just as it is to the household refrigerators having plate-type evaporators. Defrosting of such freezers can be accomplished by the system of this invention as the defrosting does not require much time, and thus, does not result in any significant change in the temperature of the food products stored in the freezer. Furthermore, with the defrosting beginning at the surfaces of the evaporator and progressing outwardly through the layer of accumulated ice, rather than in a reverse direction, the presence of packages or containers of food in tile freezer, or located adjacent the heat transfer surface, has no significant effect on the defrosting operation. Additionally a freezer provided with a defrosting system of this invention is adapted to be subjected to a defrost cycle at frequent intervals, thereby tending to avoid accumulation of thick layers of ice. Where manual defrosting techniques must be employed, there is a tendency to procrastinate in performing defrosting, thus contributing to the likelihood of build-up of a thick layer of ice. Ice being a thermal insulator, the build-up of a thick layer of ice will degrade the freezer's efficiency.

The defrost evaporator need be only of relatively small size or capacity as compared to the freezer evaporator with which it is used. In this description of the embodiments of this invention, the system is described as having a second evaporator, but this terminology is to be broadly construed as including heat exchangers of diverse constructions. The heat exchanger selected is to have the capability to extract heat from a suitable source to effect elevation of the temperature of the refrigerant flowing through this portion of the system, particularly through the freezer evaporator.

Figure 4:
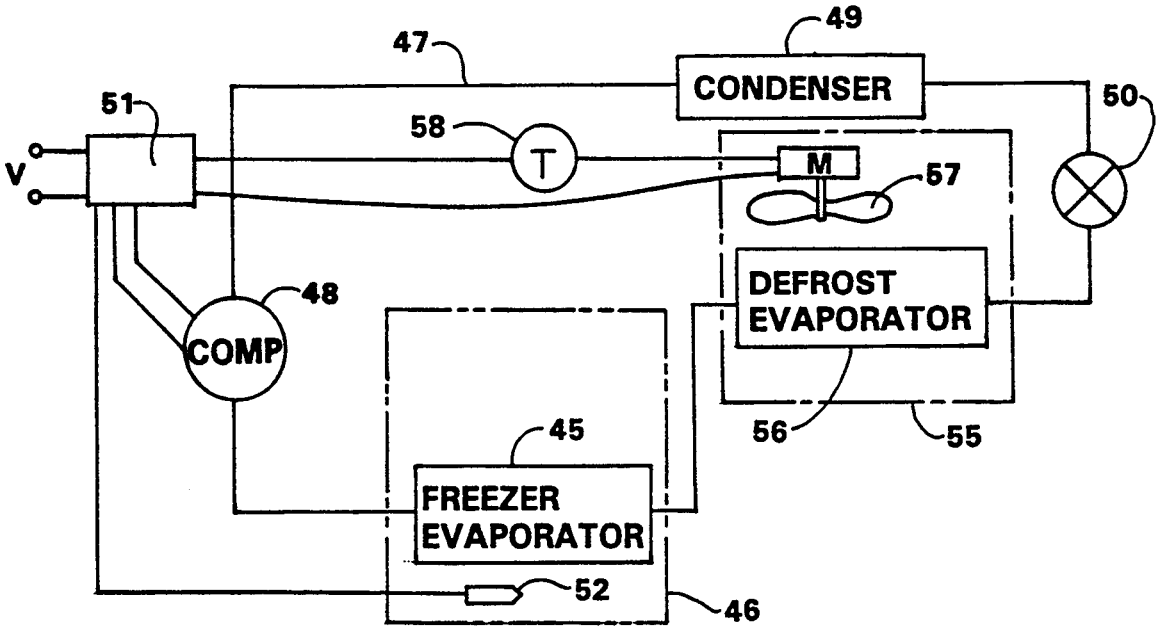
FIG. 4 is a schematic block diagram of a third modified refrigeration system embodying this invention.

In the FIG. 3 and 4 embodiments, the defrost evaporator may tend to accumulate small quantities of frost or ice when not functioning in the defrost mode. The system is to be designed for operation in a manner to minimize any such accumulations. Those accumulations will be quickly removed upon initiation of a defrost cycle.

It will be readily apparent from the foregoing description of the illustrative embodiments of this invention that a highly advantageous defrost system is provided for refrigeration apparatus. The inventive system using a second evaporator to periodically elevate the temperature of the refrigerant flowing through the freezer evaporator to above the freezing point of water is highly effective in defrosting of the freezer evaporator. The defrost system of this invention minimizes the cost of defrosting a freezer evaporator through application of heat to the evaporator structure, thereby avoiding the time-consuming process of applying heat to the ice so as to effect melting of the ice inwardly to the evaporator surface as is necessary with prior art systems. This results in less time required to effect defrosting and, consequently, less cost. Additionally, this new defrost system using a second evaporator that is connected in series with the freezer compartment evaporator, but located outside of the freezer compartment, enables an automatic defrost system to be incorporated with plate-type evaporator structures as well as fin coil type evaporators.

Having thus described this invention, what is claimed is:

1. Refrigeration apparatus comprising

A) a refrigeration chamber for containing material that is to be maintained at a first predetermined temperature which is lower than the freezing point of the material;

B) a refrigeration system for maintaining the material in said chamber at the predetermined temperature, said system including 1) a refrigerant compressor;

2) a refrigerant condensor;

3) a first refrigerant evaporator disposed in heat transferring relationship to the interior of said refrigeration chamber; and 4) a refrigerant expansion control device; all of said compressor, condensor, first refrigerant evaporator and expansion control devices being interconnected in series flow relationship by a refrigerant conduit whereby a fluid refrigerant may be caused to flow therethrough for effecting operation of said refrigeration systems, C) defrosting means operatively interconnected with said refrigeration system for effecting defrosting of said first refrigerant evaporator, said defrosting means including 1) defrosting evaporator interconnected in said refrigerant conduit in preceding refrigerant flow relationship to said first refrigerant evaporator and following said expansion control device, said defrosting evaporator disposed externally to said refrigeration chamber at a location where it is not in heat transferring relationship with air enclosed within said refrigeration chamber, and 2) heat generating means disposed in heat transferring relationship to said defrosting evaporator and selectively operable at predetermined intervals of time for transferring a sufficient quantity of heat to said defrosting evaporator to elevate the temperature of the refrigerant flowing therethrough and into said first evaporator to a magnitude that is above the freezing point of water to effect removal of ice accumulated on the exterior surfaces of said first evaporator.

2. Refrigeration apparatus according to claim 1 wherein said heat generating means includes an electric resistance heating element disposed closely adjacent said defrosting evaporator.

3. Refrigeration apparatus according to claim 2 wherein said heat generating means includes control means for effecting energization of said heating element at selected times for intervals of predetermined duration.

4. Refrigeration apparatus according to claim 3 wherein said control means includes an electrically operated timing device.

5. Refrigerating apparatus comprising

A) a refrigeration chamber for containing material that is to be maintained at a first predetermined temperature which is lower than the freezing point of the material;

B) a refrigeration system for maintaining the material in said chamber at the predetermined temperature, said system including 1) a refrigerant compressor;

2) a refrigerant condensor which also forms a heated air source;

3) a first refrigerant evaporator disposed in heat transferring relationship to the interior of said refrigeration chamber; and 4) a refrigerant expansion control device; all of said compressor, condensor, first refrigerant evaporator and expansion control devices being interconnected in series flow relationship by a refrigerant conduit whereby a fluid refrigerant may be caused to flow therethrough for effecting operation of said refrigeration systems, C) defrosting means operatively interconnected with said refrigeration system for effecting defrosting of said first refrigerant evaporator, said defrosting means including 1) a defrosting evaporator interconnected in said refrigerant conduit in preceding refrigerant flow relationship to said first refrigerant evaporator and following said expansion control device, said defrosting evaporator disposed externally to said refrigeration chamber at a location where it is not in heat transferring relationship with air enclosed within said refrigeration chamber, and 2) heat generating means disposed in heat transferring relationship to said defrosting evaporator and selectively operable at predetermined intervals of time for transferring a sufficient quantity of heat to said defrosting evaporator to elevate the temperature of the refrigerant flowing therethrough and into said first evaporator to a magnitude that is above the freezing point of water to effect removal of ice accumulated on the exterior surfaces of said first evaporator, said heat generating means including air displacing means disposed to effect displacement of heated air from said condensor into heat exchanging relationship with said defrosting evaporator to thereby cause said defrosting evaporator to extract heat from said heated air.

6. Refrigeration apparatus according to claim 5 wherein said condensor and said defrosting evaporator are disposed with respect to each other in relative physical relationship and to said air displacing means whereby heated air is displaced from said condensor to said defrosting evaporator by said air displacing means.

7. Refrigeration apparatus according to claim 6 wherein said air displacing means includes an air circulating fan driven by an electric motor disposed in airflow-coupled relationship with said condensor and said defrosting evaporator.

8. Refrigeration apparatus according to claim 7 wherein said heat generating means includes control means for effecting operation of said air circulating fan at selected times for intervals of predetermined duration.

9. Refrigeration apparatus according to claim 8 wherein said control means includes an electrically operated timing device.

10. Refrigeration apparatus comprising

A) a refrigeration apparatus chamber for containing material that is to be maintained at a first predetermined temperature which is lower than the freezing point of the material;

B) a material cooling compartment wherein material placed therein is to be maintained at a second predetermined temperature which is above the freezing point of water;

C) a refrigeration system for maintaining the material in said chamber at the predetermined temperature, said system including 1) a refrigerant compressor;

2) a refrigerant condensor;

3) a first refrigerant evaporator disposed in heat transferring relationship to the interior of said refrigeration chamber; and 4) a refrigerant expansion control device; all of said compressor, condensor, first refrigerant evaporator and expansion control device being interconnected in series flow relationship by a refrigerant conduit whereby a fluid refrigerant may be caused to flow therethrough for effecting operation of said refrigeration systems, D) defrosting means operatively interconnected with said refrigeration system for effecting defrosting of said first refrigerant evaporator, said defrosting means including 1) a defrosting evaporator interconnected in said refrigerant conduit in preceding refrigerant flow relationship to said first refrigerant evaporator and following said expansion control device, said defrosting evaporator being disposed in said cooling compartment and operative to effect cooling of the air and material in said cooling compartment and the maintenance thereof at said second predetermined temperature, and 2) heat generating means disposed in heat transferring relationship to said defrosting evaporator and selectively operable at predetermined intervals of time for transferring a sufficient quantity of heat to said defrosting evaporator to elevate the temperature of the refrigerant flowing therethrough and into said first evaporator to a magnitude that is above the freezing point of water to effect removal of ice accumulated on the exterior surfaces of said first evaporator, said heat generating means including air displacing means disposed to effect displacement of air in said cooling compartment into heat exchanging relationship with said defrosting evaporator to thereby cause extraction of heat from the air by said defrosting evaporator, said air displacing means including control means for effecting operation of said air displacing means at selected times for intervals of predetermined duration.

11. Refrigeration apparatus according to claim 10 wherein said air displacing means includes an air circulating fan driven by an electric motor and disposed in said cooling compartment.

12. Refrigeration apparatus according to claim 10 wherein said control means includes an electrically operated timing device.

13. Refrigeration apparatus comprising

A) a refrigeration chamber for containing material that is to be maintained at a first predetermined temperature which is lower than the freezing point of the material;

B) a refrigeration system for maintaining the material in said chamber at the predetermined temperature, said system including 1) a refrigerant compressor;

2) a refrigerant condensor;

3) a first refrigerant evaporator disposed in heat transferring relationship to the interior of said refrigeration chamber; and 4) a refrigerant expansion control device; all of said compressor, condensor, first refrigerant evaporator and expansion control devices being interconnected in series flow relationship by a refrigerant conduit whereby a fluid refrigerant may be caused to flow therethrough for effecting operation of said refrigeration systems, C) defrosting means operatively interconnected with said refrigeration system for effecting defrosting of said first refrigerant evaporator, said defrosting means including 1) a defrosting evaporator interconnected in said refrigerant conduit in preceding refrigerant flow relationship to said first refrigerant evaporator and following said expansion control device, said defrosting evaporator disposed externally to said refrigeration chamber at a location where it is not in heat transferring relationship with air enclosed within said refrigeration chamber, and 2) heat generating means disposed in heat transferring relationship to said defrosting evaporator and selectively operable at predetermined intervals of time for transferring a sufficient quantity of heat to said defrosting evaporator to elevate the temperature of the refrigerant flowing therethrough and into said first evaporator to a magnitude that is above the freezing point of water to effect removal of ice accumulated on the exterior surfaces of said first evaporator, said heat generating means including a heated air source where the air is at a temperature that is above the freezing point temperature of water, and air displacing means disposed in operative relationship to said heated air source and said defrosting evaporator for effecting displacement of the heated air into heat transferring relationship to said defrosting evaporator to thereby cause extraction of heat from the heated air by said defrosting evaporator.

* * * * *